US006095431A

United States Patent [19]

Kiest, Sr.

[11] Patent Number: 6,095,431

[45] Date of Patent: Aug. 1, 2000

[54] MATERIAL APPLYING DEVICE

[76] Inventor: Larry W. Kiest, Sr., Rte. #3 - 3305 E. 2153 Rd., Ottawa, Ill. 61350

[21] Appl. No.: 08/992,561

[22] Filed: Dec. 17, 1997

[51] Int. Cl.[7] ..... B05B 3/10

[52] U.S. Cl. ..... 239/224; 239/263.1

[58] Field of Search ..... 239/223, 224, 239/281, 654, 263.1, 263, 532

[56] References Cited

U.S. PATENT DOCUMENTS

| | | | |
|---|---|---|---|
| 2,901,178 | 3/1959 | Norris | 239/224 |
| 2,990,011 | 6/1961 | Stratford | 239/224 X |
| 3,719,168 | 3/1973 | Kazze | 239/223 |
| 3,749,315 | 7/1973 | Crathern | 239/224 |
| 5,452,853 | 9/1995 | Shook et al. | 239/224 X |

FOREIGN PATENT DOCUMENTS

| | | | |
|---|---|---|---|
| 2043489 | 10/1980 | United Kingdom | 239/223 |

*Primary Examiner*—Kevin Weldon

[57] ABSTRACT

A new material applying device for applying material to the inner surface of a confined area. The inventive device includes a spinning plate with a plurality of radial fins that extend radially outward from the spinning plate center. The spinning plate is coupled to a lower end of an elongate spinning shaft. An upper end of the spinning shaft is rotatably mounted to a mounting carriage to permit rotation of the spinning shaft about its longitudinal axis. A motor rotates the spinning shaft about its longitudinal axis. A handle extends from the upper end of the mounting carriage for suspending the material applying device. A top plate is coupled to the mounting carriage and is positioned between a lower end of the mounting carriage and the spinning plate, adjacent the radial fins. An elongate feed tube with a hollow interior is coupled to the mounting carriage. An open bottom end of the feed tube extends through a feed opening in the top plate and faces the upper surface of the spinning plate. An open top end of the feed tube connects to a reservoir of material.

1 Claim, 2 Drawing Sheets

MATERIAL APPLYING DEVICE

BACKGROUND OF THE INVENTION

1. Field of the Invention

The present invention relates to application devices and more particularly pertains to a new material applying device for applying material to the inner surface of a confined area.

2. Description of the Prior Art

The use of application devices is known in the prior art. More specifically, application devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art application devices include U. S. Pat. No. 4,176,717; U.S. Pat. No. 4,083,406; U.S. Pat. No. 5,194,193; U.S. Pat. No. 4,191,254; U.S. Pat. No. 4,784,223; and U.S. Pat. No. Des. 354,289.

While these devices fulfill their respective, particular objectives and requirements, the aforementioned patents do not disclose a new material applying device. The inventive device includes a spinning plate with a plurality of radial fins that extend radially outward from the spinning plate center. The spinning plate is coupled to a lower end of an elongate spinning shaft. An upper end of the spinning shaft is rotatably mounted to a mounting carriage to permit rotation of the spinning shaft about its longitudinal axis. A rotation means rotates the spinning shaft about its longitudinal axis. A handle extends from the upper end of the mounting carriage for suspending the material applying device. A top plate is coupled to the mounting carriage and is positioned between a lower end of the mounting carriage and the spinning plate, adjacent the radial fins. An elongate feed tube with a hollow interior is coupled to the mounting carriage. An open bottom end of the feed tube extends through a feed opening in the top plate and faces the upper surface of the spinning plate. An open top end of the feed tube connects to a reservoir of material.

In these respects, the material applying device according to the present invention substantially departs from the conventional concepts and designs of the prior art, and in so doing provides an apparatus primarily developed for the purpose of applying material to the inner surface of a confined area.

SUMMARY OF THE INVENTION

In view of the foregoing disadvantages inherent in the known types of application devices now present in the prior art, the present invention provides a new material applying device construction wherein the same can be utilized for applying material to the inner surface of a confined area.

The general purpose of the present invention, which will be described subsequently in greater detail, is to provide a new material applying device apparatus and method which has many of the advantages of the application devices mentioned heretofore and many novel features that result in a new material applying device which is not anticipated, rendered obvious, suggested, or even implied by any of the prior art application devices, either alone or in any combination thereof.

To attain this, the present invention generally comprises a spinning plate with a plurality of radial fins that extend radially outward from the spinning plate center. The spinning plate is coupled to a lower end of an elongate spinning shaft. An upper end of the spinning shaft is rotatably mounted to a mounting carriage to permit rotation of the spinning shaft about its longitudinal axis. A rotation means rotates the spinning shaft about its longitudinal axis. A handle extends from the upper end of the mounting carriage for suspending the material applying device. A top plate is coupled to the mounting carriage and is positioned between a lower end of the mounting carriage and the spinning plate, adjacent the radial fins. An elongate feed tube with a hollow interior is coupled to the mounting carriage. An open bottom end of the feed tube extends through a feed opening in the top plate and faces the upper surface of the spinning plate. An open top end of the feed tube connects to a reservoir of material.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new material applying device apparatus and method which has many of the advantages of the application devices mentioned heretofore and many novel features that result in a new material applying device which is not anticipated, rendered obvious, suggested, or even implied by any of the prior art application devices, either alone or in any combination thereof.

It is another object of the present invention to provide a new material applying device which may be easily and efficiently manufactured and marketed.

It is a further object of the present invention to provide a new material applying device which is of a durable and reliable construction.

An even further object of the present invention is to provide a new material applying device which is susceptible of a low cost of manufacture with regard to both materials and labor, and which accordingly is then susceptible of low prices of sale to the consuming public, thereby making such material applying device economically available to the buying public.

Still yet another object of the present invention is to provide a new material applying device which provides in the apparatuses and methods of the prior art some of the advantages thereof, while simultaneously overcoming some of the disadvantages normally associated therewith.

Still another object of the present invention is to provide a new material applying device for applying material to the inner surface of a confined area.

Yet another object of the present invention is to provide a new material applying device which includes a spinning plate with plurality of radial fins that extend radially outward from the pinning plate center. The spinning plate is coupled to a lower end of an elongate spinning shaft. An upper end of the spinning shaft is rotatably mounted to a mounting carriage to permit rotation of the spinning shaft about its longitudinal axis. A rotation means rotates the spinning shaft about its longitudinal axis. A handle extends from the upper end of the mounting carriage for suspending the material applying device. A top plate is coupled to the mounting carriage and is positioned between a lower end of the mounting carriage and the spinning plate, adjacent the radial fins. An elongate feed tube with a hollow interior is coupled to the mounting carriage. An open bottom end of the feed tube extends through a feed opening in the top plate and faces the upper surface of the spinning plate. An open top end of the feed tube connects to a reservoir of material.

Still yet another object of the present invention is to provide a new material applying device that applies material in places where application by hand would be difficult or impossible Even still another object of the present invention is to provide a new material applying device that increases safety by mechanically applying hazardous material in an enclosed area where application by hand would be unsafe.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
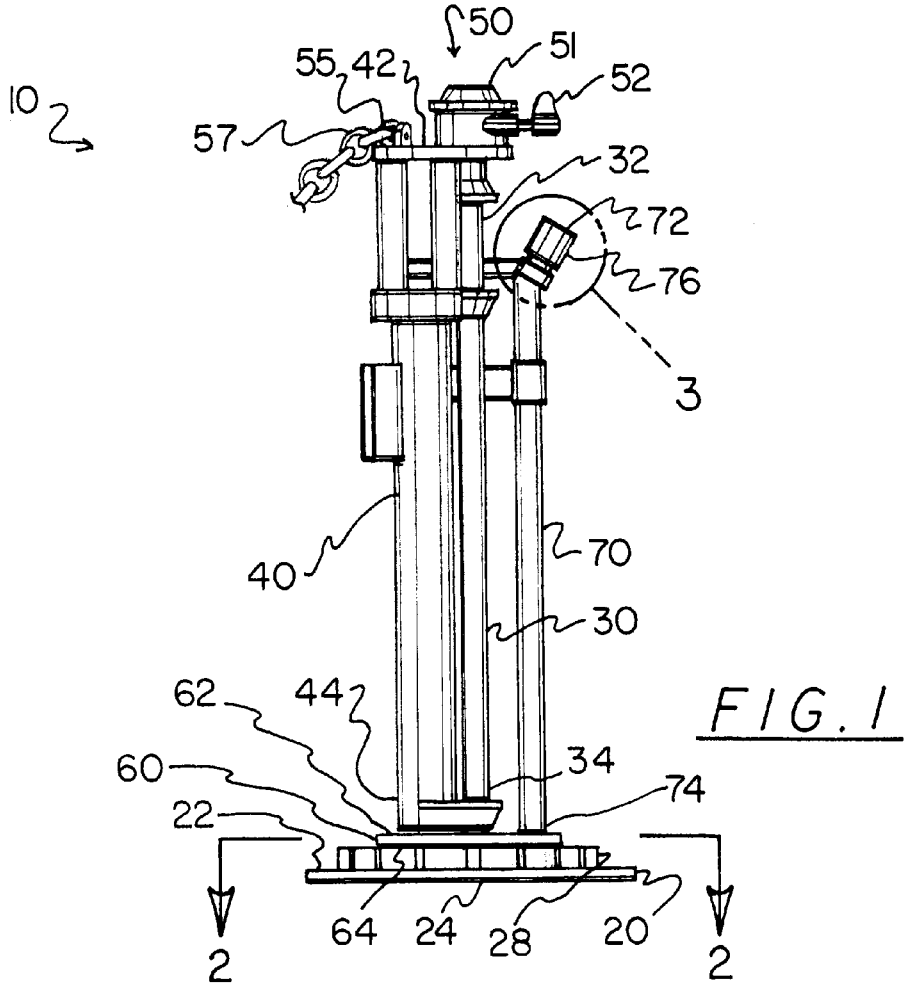
FIG. 1 is a side view of a new material applying device according to the present invention.

With reference now to the drawings, and in particular to FIGS. 1 through 4 thereof, a new material applying device embodying the principles and concepts of the present invention and generally designated by the reference numeral 10 will be described.

As best illustrated in FIGS. 1 through 4, the material applying device 10 comprises a spinning plate 20 with a plurality of radial fins 28 that extend radially outward from the spinning plate center 26. The spinning plate 20 is coupled to a lower end 34 of an elongate spinning shaft 30. An upper end 32 of the spinning shaft 30 is rotatably mounted to a mounting carriage 40 to permit rotation of the spinning shaft 30 about its longitudinal axis. A rotation means 50 rotates the spinning shaft 30 about its longitudinal axis. A handle 55 extends from the upper end 42 of the mounting carriage 40 for suspending the material applying device 10. A top plate 60 is coupled to the mounting carriage 40 and is positioned between a lower end 44 of the mounting carriage 40 and the spinning plate 20, adjacent the radial fins 28. An elongate feed tube 70 with a hollow interior is coupled to the mounting carriage 40. An open bottom end 74 of the feed tube 70 extends through a feed opening 68 in the top plate 60 and faces the upper surface 22 of the spinning plate 20. An open top end 72 of the feed tube 70 connects to a reservoir of material (not shown) or a material hose (not shown).

Figure 2:
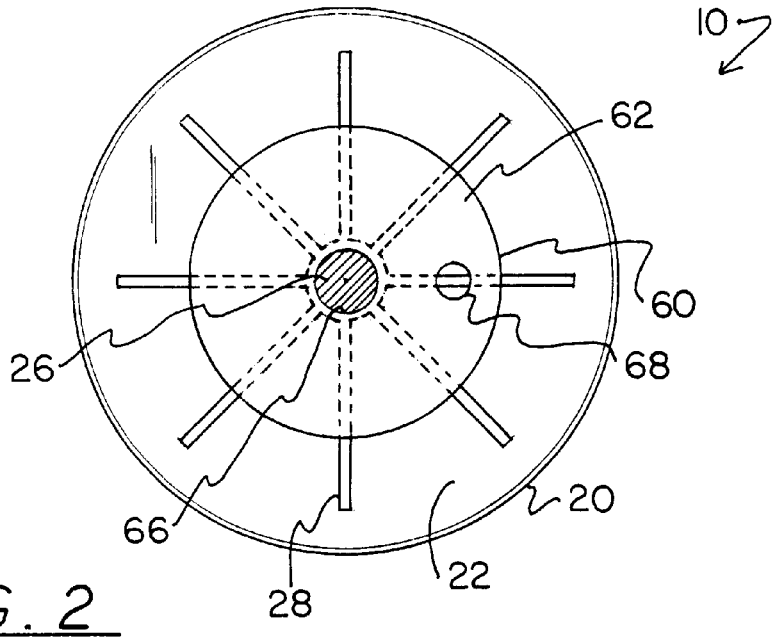
FIG. 2 is a cross-sectional view of the present invention taken from line 2—2 of FIG. 1.

As illustrated in FIGS. 1 and 2, a spinning plate 20 includes upper and lower surfaces 22, 24 and a center 26. The upper surface 22 of the spinning plate 20 has a plurality of radial fins 28 that extend radially outward from the spinning plate center 26. Preferably, the spinning plate 20 is circular and has a radius. Also preferably, the upper and lower surfaces 22, 24 of the spinning plate 20 are substantially planar.

An elongate spinning shaft 30 includes opposite upper and lower ends 32, 34 and a longitudinal axis. The lower end 34 of the spinning shaft 30 is coupled to the spinning plate 20. Preferably, the spinning shaft 30 is coupled to the center 26 of the spinning plate 20 and extends substantially perpendicular from the spinning plate upper surface 22.

The spinning shaft 30 is rotatably mounted to the mounting carriage 40 to permit rotation of the spinning shaft 30 about its longitudinal axis. The mounting carriage 40 has upper and lower ends 42, 44.

As shown in FIG. 1, a rotation means 50 rotates the spinning shaft 30 about its longitudinal axis. Preferably, the rotation means 50 includes a motor 51 and an actuator 52. The motor 51 is positioned towards the upper end 42 of the mounting carriage 40 and mounted to the mounting carriage 40. The motor 51 engages the upper end 32 of the spinning shaft 30 to rotate the spinning shaft 30 when actuated. The actuator 52 is operationally coupled to the motor 51 to selectively actuate the motor 51. The actuator 52 is located towards the upper end 42 of the mounting carriage 40. Ideally, the motor 51 is powered by electricity or compressed air. Also ideally, the actuator 52 permits adjustment and control of the rotational velocity of the motor 51 to control the thickness of the material applied as well as to make adjustments for use in larger and smaller spaces.

A handle 55 for suspending the mounting carriage 40 extends from the upper end 42 of the mounting carriage 40. Preferably, as shown in FIG. 1, the handle 55 includes an elongate flexible member 57 such as a chain.

A top plate 60 includes an upper and lower surfaces 62, 64, a center opening 66, and a feed opening 68. The top plate 60 is coupled to the mounting carriage 40 and is positioned between the lower end 44 of the mounting carriage 40 and the spinning plate 20 such that the top plate lower surface 64 is positioned adjacent the radial fins 28. Preferably, the upper and lower surfaces 62, 64 of the top plate 60 are substantially planar. Also preferably, the top plate 60 is circular and includes a radius. As shown in FIG. 2, the spinning plate radius is greater than the top plate radius such that the radial fins 28 extend past the edge of the top plate 60. In use, the top plate 60 assists spreading of the material in an entire circle by preventing the material from completely spinning out in less than a full circle.

Figure 3:
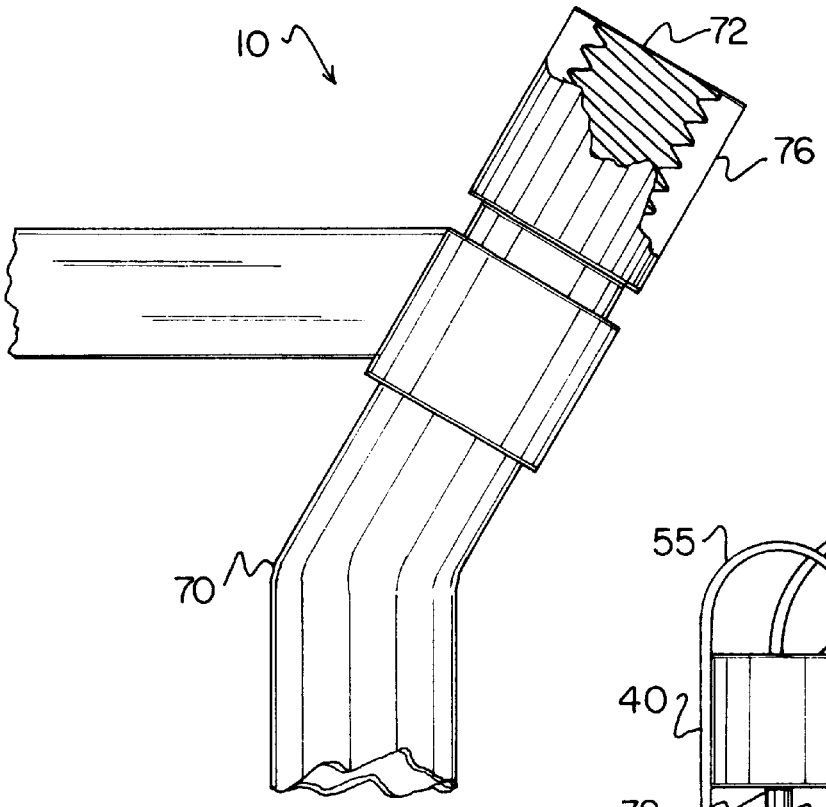
FIG. 3 is a detailed view of the present invention taken from circle 3—3 of FIG. 1.

An elongate feed tube 70 is coupled to the mounting carriage 40 and includes a hollow interior and opposite open top and bottom ends 72, 74. The feed tube bottom end 74 extends through the feed opening 68 of the top plate 60. The open bottom end 74 of the feed tube 70 faces the upper surface 22 of the spinning plate 20. The open top end 72 of the feed tube 70 connects to a reservoir of material. Preferably, as shown in FIG. 3, the open top end 72 includes a threaded coupling means 76 which attaches to a material hose such that the feed tube open top end 72 is in fluid communication with the material reservoir. Optionally, the open top end 72 may include an adapter that may be coupled to a material reservoir or material hose.

In use, material to be applied, such as concrete or two-part epoxy, is provided in a material reservoir (not shown). A hose or other fluid transport means connects the reservoir and the open top end 72 of the feed tube 70. A pump, for example, may be provided between the material reservoir and the feed tube 70 to transport material from the material reservoir to the feed tube 70, or gravity feed may be employed. The actuator 52 is manipulated to actuate the motor 51. The material applying device 10 is lowered by the handle 55 into a confined space, such as the interiors of manholes, sewer pipes, wells or underground tanks. Material passes through the feed tube open bottom end 74 and comes in contact with the rotating spinning plate upper surface 22. The material is spread out in a circle by centrifugal force to cover the walls of the confined space. Once in use, the rotational velocity of the motor 51 may be adjusted to adjust the amount of material striking the walls or to compensate for larger or smaller enclosed areas. The flow rate of material may also be adjustable to vary the amount of material spread per rotation. The material spreading device 10 is raised and lowered to coat the walls of the confined space to the desired thickness.

The material applying device 10 may also be used on its side in the center of a horizontal pipe or tunnel, such as a sewer drain pipe, by mounting the material applying device 10 on skids or wheels and moving it through the pipe or tunnel.

Figure 4:
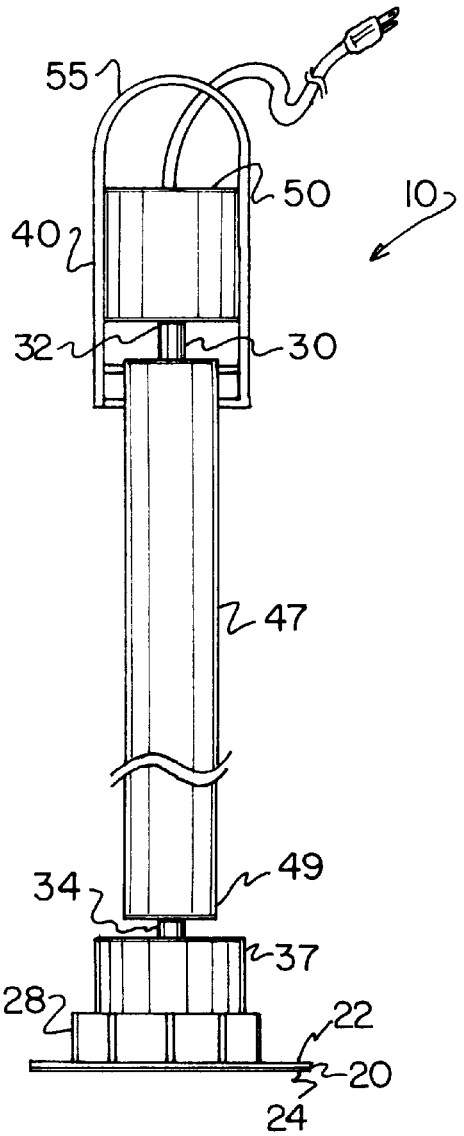
FIG. 4 is a side view of an alternate embodiment of the present invention.

In an alternate embodiment, as shown in FIG. 4, the material applying device 10 includes a self-contained material reservoir 47 surrounding an elongate spinning shaft 30 and coupled to a mounting carriage 40. A spinning plate 20 with a plurality of radial fins 28 is coupled to the lower end 34 of the spinning shaft 30. A rotation means 50 is coupled to an upper end 32 of the spinning shaft 30 to rotate the spinning shaft 30 about its longitudinal axis. The rotation means 50 is coupled to the mounting carriage 40. A handle 55 extends from the upper end 42 of the mounting carriage 40. A top cylinder 37 with a hollow interior is coupled to the spinning shaft 30 and is positioned below the self contained material reservoir 47 and adjacent the radial fins 28. In use, the self contained material reservoir 47 is filled with material and the rotation means 50 is actuated. As the material applying device is lowered into a confined space by the handle 55, apertures in the bottom end 49 of the self contained material reservoir 47 permit the material to drop in a controlled flow through the top cylinder hollow interior and onto the spinning plate upper surface 22. The material is spread out in a circle by centrifugal force to cover the walls of a confined space.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A device for applying material comprising:

a circular spinning plate having substantially planar upper and lower surfaces, a radius, and a center;

said upper surface of said spinning plate having a plurality of radial fins extending radically outward from said spinning plate center, each of said radial fins having a radially outward edge such that a radial length of said radial fin is defined between the center of the spinning plate and said radially outward edge, wherein the radius of the spinning plate is substantially greater than the length of the radial fins such that the spinning plate extends beyond the radial fins to thereby direct material flowing off of said radial fins in a radially outward direction while minimizing downward travel by the material, wherein the radial length of each of said radial fins is approximately 85% of the radius of the spinning plate;

an elongate spinning shaft having opposite upper and lower ends, said lower end of said spinning shaft lower end being coupled to said spinning plate, said spinning shaft being, extended substantially perpendicular from said spinning plate upper surface;

an elongate mounting carriage having upper and lower ends, said spinning shaft being rotatably mounted to said mounting carriage to permit rotation of said spinning shaft about its longitudinal axis;

rotation means for rotating said spinning shaft about its longitudinal axis, said rotation means including a motor and an actuator, said motor being mounting to said mounting carriage, said motor being positioned towards said upper end of said mounting carriage away from said spinning plate such that said motor is spaced from tile location of material distribution from the upper surface of tile spinning plate, said motor engaging said upper end of said spinning shaft, said motor rotating said spinning shaft when actuated, said actuator being located towards said upper end of said mounting carriage for permitting said actuator to be raised above a mouth of a hole for actuation without raising said spinning plate above the mouth of the hole, said actuator being operational coupled to said motor to selectively actuate said motor;

an elongate flexible member being extended from said tipper end of said mounting carriage, said flexible member being for suspending said mounting carriage;

a circular top plate having substantially planar upper and lower surfaces, a center opening, a feed opening, and a radius, said top plate being coupled to said mounting carriage, said top plate being positioned between said lower end of said mounting carriage and said spinning plate, the feed opening of said top plate being radially spaced from the center opening of said top plate, said top plate lower surface being positioned adjacent said radial fins, said spinning plate radius being greater than said top plate radius, wherein the spinning plate radius is approximately half of the top plate radius such that a large portion of the upper surface of the spinning plate is viewable from above the top plate; and an elongate feed tube having a hollow interior, and opposite open top and bottom ends, said feed tube bottom end being extended through said feed opening of said top plate, said open bottom end of said feed tube facing said upper surface of said spinning plate, said open top end being for connecting to a reservoir of material, said feed tube being coupled to said mounting carriage, said feed tube extending substantially parallel to said spinning shaft and substantially perpendicular to the upper surface of said spinning plate for facilitating gravity feed of a material to said spinning plate;

wherein the motor of said rotating means is located above the open top end of the elongate feed tube such that any leakage of material from a connection with said open top end does not fall downward onto the motor.

* * * * *